US009060388B2

(12) United States Patent
Liu

(10) Patent No.: US 9,060,388 B2
(45) Date of Patent: Jun. 16, 2015

(54) ELECTRONIC CIGARETTE CIRCUIT

(75) Inventor: Qiuming Liu, Shenzhen (CN)

(73) Assignee: HUIZHOU KIMREE TECHNOLOGY CO., SHENZHEN BRANCH, Shenzhen, Guangdong Province (CN)

( * ) Notice: Subject to any disclaimer, the term of this patent is extended or adjusted under 35 U.S.C. 154(b) by 335 days.

(21) Appl. No.: 13/583,620

(22) PCT Filed: Jun. 4, 2012

(86) PCT No.: PCT/CN2012/076452

§ 371 (c)(1),
(2), (4) Date: Sep. 7, 2012

(87) PCT Pub. No.: WO2013/181789

PCT Pub. Date: Dec. 12, 2013

(65) Prior Publication Data

US 2013/0319989 A1 Dec. 5, 2013

(51) Int. Cl.

| | |
|---|---|
| ***H05B 3/00*** | (2006.01) |
| ***H05B 1/02*** | (2006.01) |
| ***A24F 47/00*** | (2006.01) |

(52) U.S. Cl.
CPC ..... *H05B 1/0244* (2013.01); *A24F 47/008* (2013.01); *H05B 2203/022* (2013.01)

(58) Field of Classification Search
CPC ..... H05B 1/0244; H05B 2203/022; A24F 47/008
USPC ..... 131/299
See application file for complete search history.

(56) References Cited

U.S. PATENT DOCUMENTS

| | | | | |
|---|---|---|---|---|
| 5,144,962 | A * | 9/1992 | Counts et al. | 131/194 |
| 2007/0210072 | A1* | 9/2007 | Yabe | 219/505 |
| 2010/0242974 | A1* | 9/2010 | Pan | 131/273 |
| 2011/0209717 | A1* | 9/2011 | Han | 131/273 |
| 2012/0205362 | A1* | 8/2012 | Etzkorn et al. | 219/201 |
| 2013/0255702 | A1* | 10/2013 | Griffith et al. | 131/328 |

OTHER PUBLICATIONS

Transistor Level Implementation of CMOS Combinational Logic Circuits, Jeff Beasley et al, 1997.*

* cited by examiner

*Primary Examiner* — Sang Y Paik
(74) *Attorney, Agent, or Firm* — Cheng-Ju Chiang

(57) ABSTRACT

This invention discloses an electronic cigarette circuit, including an IC, an airflow sensor connected to the IC, a heating wire and a power supply VDD connected to the IC and the heat wire, the electronic cigarette circuit further including a switch device, the switch device being connected with the heating wire and the power supply VDD to form a circuit loop. The electronic cigarette circuit of the present invention adopts a switch device placed outside the IC, and the IC, the heating wire and the power supply form the circuit loop, so as to achieve high power output to the heating wire, and a large amount of smoke, with a simple circuit structure for ease mass production.

5 Claims, 2 Drawing Sheets

ELECTRONIC CIGARETTE CIRCUIT

CROSS REFERENCE TO RELATED APPLICATIONS

The present application is a 35 U.S.C. §371 National Phase conversion of International (PCT) Patent Application No. PCT/CN2012/076452, filed on Jun. 4, 2012, the disclosure of which is incorporated by reference herein. The PCT International Patent Application was filed in Chinese.

TECHNICAL FIELD

This invention relates to electronic cigarette technologies, particularly relates to an electronic cigarette circuit.

DESCRIPTION OF BACKGROUND

Due to the global trends in smoking cessation, the electronic cigarettes become increasingly popular, and especially disposable electronic cigarettes has gradually become the market mainstream because of ease use. Currently, batteries used in disposable electronic cigarettes are disposable lithium manganese batteries, the lithium manganese batteries have replaced for secondary lithium batteries because they have the advantages relative to other disposable batteries, of high voltage up to 3.0V, high capacity volume ratio, capability of keeping the power for a long time up to 5 years etc., however the lithium manganese batteries adopt existing IC control circuit, it can be found from the finished electronic cigarette products, amount of smoke is too small to meet the requirements of customers.

The inventor(s) fully researched the existing integrated circuit (IC) control circuits and found out that the main reason of the too small amount of smoke is that the power output to the load, i.e. the heating wire, is not high, which results in that the heating wire has low temperature. The main reasons which results that the power output to the heating wire is not high are as follows:

First reason is that, the existing IC control circuits use disposable lithium manganese batteries with voltage of 3V, relative to the rechargeable lithium batteries with voltage of 4.2V, voltage of the lithium-manganese batteries is low.

Second reason is that, the internal resistance of lithium-manganese batteries is large, for the batteries of 08570 specifications with same volume, the internal resistance of a lithium manganese battery is 300 milliohms~600 milliohms, while the internal resistance of a lithium is 40 milliohms to 100 milliohms.

Third reason is that, the internal resistance of the IC's built-in switch is large, reaching 100 milliohms~200 milliohms.

Analysis reaches such conclusion that: As for the first reason, the lithium-manganese batteries have low voltage of 3V, which is determined by the characteristics of the material itself, for the disposable batteries, it is difficult to improve the voltage.

As for the second reason, the internal resistances of the lithium manganese batteries can be improved through internal process, formula and structural shape of the electrode, but currently the improvement result is not significant.

As for the third reason, the internal resistance of the IC can be improved through changing switching area and manufacturing process, but limited by the IC package volume, the improvement result is also not significant.

Therefore, how to increase the power output to the heating wire and increase the amount of smoke is a problem desired to be resolved.

SUMMARY OF THE INVENTION

The technical problems can be solved by the present invention is, to provide an electronic cigarette circuit in order to increase the power output to the heating wire, and increase the amount of the smoke.

To solve the above technical problem, the present invention provides an electronic cigarette circuit, comprising an integrated circuit (IC), an airflow sensor connected to the IC, a heating wire and a power supply VDD connected to the IC and the heat wire, the electronic cigarette circuit further comprising a switch device, the switch device being connected with the heating wire and the power supply VDD to form a circuit loop.

Furthermore, the switch device is N-type metal-oxide-semiconductor (NMOS) or P-type metal-oxide-semiconductor (PMOS) which is connected to the IC and controlled by the IC.

Furthermore, the switch device is an NMOS; wherein, a pin D of the NMOS is connected to an end of the heating wire, another end of the heating wire is connected to the power supply VDD, a fifth pin of the IC and an electrode of a capacitor C1, another end of the capacitor is grounded; a pin S of the NMOS is grounded; a pin G of the NMOS is connected to a fourth pin 4 of the IC, an end of a resistance R1, and another end of the resistance is grounded.

Furthermore, the switch device is a PMOS; wherein, a pin D of the PMOS is connected to the power supply VDD, a fifth pin 5 of the IC, an end of a resistance R1 and an electrode of a capacitor C1, another electrode of the capacitor C1 is grounded; a pin S of the PMOS is connected to one end of the heating wire, the other end of the heating wire is grounded; a pin G of the PMOS is connected to a fourth pin 4 of the IC and another end of the resistance R1.

Furthermore, resistance value of the NMOS or PMOS is 20~60 milliohms.

Furthermore, the resistance value of the NMOS or PMOS is 30 milliohms, 40 milliohms or 50 milliohms.

Furthermore, the electronic cigarette circuit further comprises an LED, a first pin 1 of the IC is connected to an end of the airflow sensor; a second pin 2 of the IC is connected to another end of the airflow sensor and an end of the LED and ground, a third pin 3 of the IC is connected to another end of the LED.

Furthermore, the switch device is a micro-mechanical switch, the micro-mechanical switch connected with the heating wire and the power supply VDD in series to form a circuit loop.

Furthermore, the power supply is a lithium manganese battery with supply voltage of 3V.

The technical benefits of the electronic cigarette circuit of the present invention is that: a switch device placed outside the IC is adopted, and the IC, the heating wire and the power supply form the circuit loop, so as to achieve high power output to the heating wire, and a large amount of smoke, with a simple circuit structure for ease mass production.

DETAILED DESCRIPTION OF THE EMBODIMENTS

It should be noted that various embodiments and characteristics of this application can be mutually combined if without conflict, the invention would be described in detail as follows in combination of drawings and specific embodiments of the present invention.

The inventor(s) of the present invention creatively provide (s) a technology solution of an external switch instead of a built-in switch of integrated circuit (IC), while retaining the IC's original control functions, due to an external switch device (in the embodiment of the present invention, the switch device are N-type metal-oxide-semiconductor (NMOS) or P-type metal-oxide-semiconductor (PMOS), its resistance value is only 20~60 milliohms, preferably 30 milliohms, 40 milliohms or 50 milliohms) with low internal resistance is used, thus, according to Ohm's law U/R=I, wherein U represents the voltage, R represents the resistance, I represents the current, the current can be caused to be larger by greatly reducing the resistance when the voltage relative to the original voltage is lowered, that is, when a lithium manganese battery with supply voltage of 3V is used as the power supply, the power output to the heating wire can be increased by use of the switch device with low internal resistance.

Furthermore, the inventor(s) made a large number of experiments to verify that, the electronic cigarettes adopting the circuit structure of the present invention can produce a large amount of smoke, meet customer demand, and has a simple circuit structure, for ease mass production; and the secondary lithium batteries or polymer batteries can only store the electricity for a short time period, 3 months to 6 months later, 60%~75% of the electricity in the batteries is left, 7 months to 12 months later, the left electricity in the batteries becomes more less, the present invention adopts disposable lithium manganese batteries which can be reserved up to 5 years instead of secondary lithium batteries or polymer batteries, thus it can be stored for a long time.

Figure 1:
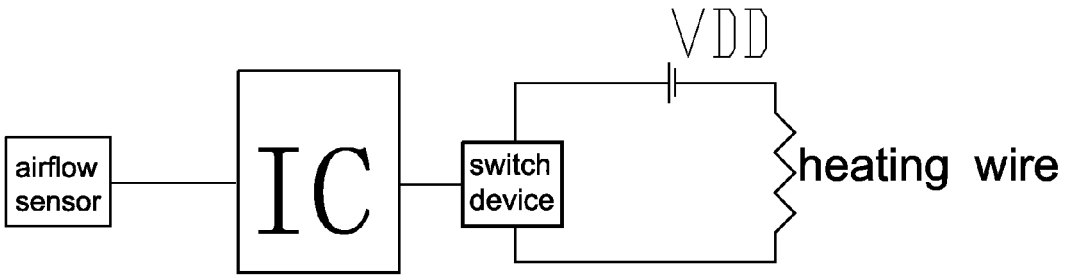
FIG. 1 is a functional schematic diagram of an electronic cigarette circuit in accordance with an embodiment of the present invention.

Please refer to FIG. 1, the electronic cigarette circuit according to the embodiment of the present invention comprises an IC, an airflow sensor connected to the IC, a heating wire and a power supply connected to the IC and the heating wire, and further comprises a switch device connected to the IC and controlled by the IC, the switch device, the heating wire and the power supply VDD are connected in series to form a circuit loop. The operation principle of the electronic cigarette circuit according to the embodiment of the present invention is as follows: the airflow sensor (microphone) senses the smoking action of the user and sends a sensing signal to the IC, the IC receives the sensing signal and generates a control signal to the switch device, the switch device receives the control signal and then is closed or disconnected, therefore to close or disconnect the circuit loop of the switch device, the heating wire and the power supply, and thus to heat the heating wire or stop heating.

Figure 2:
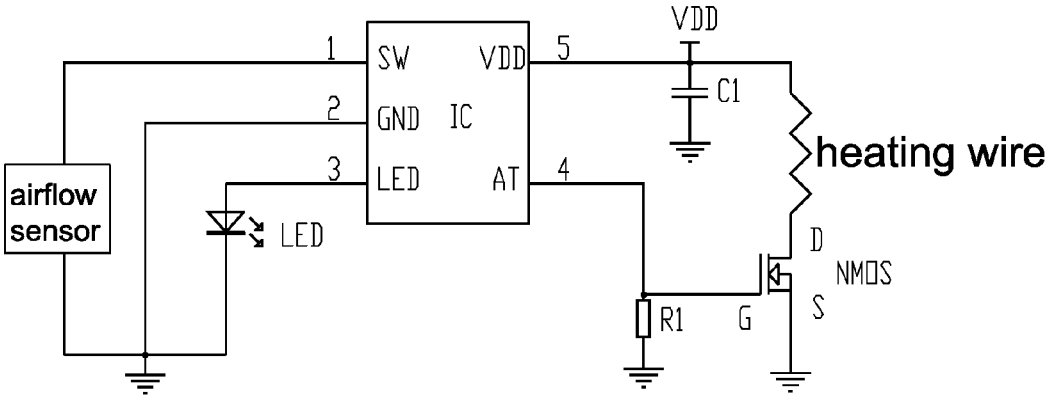
FIG. 2 is a circuit diagram of an electronic cigarette circuit in accordance with a first embodiment of the present invention.
Figure 3:
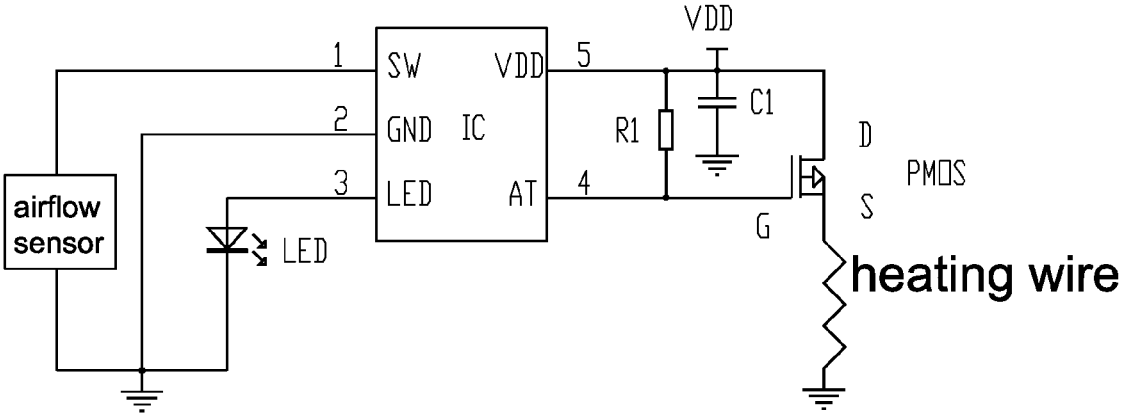
FIG. 3 is a circuit diagram of an electronic cigarette circuit in accordance with a second embodiment of the present invention.

Please refer to FIG. 2 to FIG. 3, for the electronic cigarette circuits in the first embodiment and the second embodiment of the present invention, the same structure is the airflow sensor and a circuit to which an LED corresponds, specifically, the electronic cigarette circuit further comprises the LED, a first pin 1 of the IC is connected to an end of the airflow sensor; a second pin 2 of the IC is connected to both another end of the airflow sensor and an end of the LED and grounded, a third pin 3 of the IC is connected to another end of the LED.

The difference between the two electronic cigarette circuits according to the first and second embodiments is the switch device and the corresponding circuit.

The switch device of the electronic cigarette as shown in FIG. 2 adopts NMOS. Wherein the pin D of the NMOS is connected to an end of the heating wire, another end of the heating wire is connected to the power supply VDD, a fifth pin 5 of the IC and an electrode of the capacitor C1, another electrode of the capacitor C1 is grounded;

the pin S of the NMOS is grounded; and the pin G of the NMOS is connected to a fourth pin of the NMOS and an end of a resistance R1, another end of the resistance R1 is grounded.

The switch device of the electronic cigarette as shown in FIG. 3 adopts PMOS. Wherein the pin D of the PMOS is connected to the power supply VDD, a fifth pin 5 of the IC, an end of the resistance R1 and an electrode of a capacitor C1, another electrode of the capacitor C1 is grounded;

the pin S of the PMOS is connected to one end of the heating wire, the other end of the heating wire is grounded; and the pin G of the PMOS is connected to a fourth pin 4 of the IC and another end of the resistance R1.

Based on the above difference, a difference in operation principle between the electronic cigarette circuits as shown in FIG. 2 and FIG. 3 is that the control signals to conduct the switch device are different. Specifically, the switch device in FIG. 2 adopts the NMOS, the IC receives the sensing signal from the airflow sensor and generates a high level control signal which is sent to the NMOS through the fourth pin 4, the NMOS receives the high level control signal and is conducted, thereby the circuit loop is conducted, and the heating wire is then heated. The switch device in FIG. 3 adopts PMOS, the IC receives the sensing signal from the airflow sensor and generates a low level control signal which is sent to the PMOS through the fourth pin 4, the PMOS receives the low level control signal and is conducted, thereby the circuit loop is conducted, and the heating wire is then heated.

In another embodiment of the present invention, the electronic cigarette circuit comprises an IC, an airflow sensor connected to the IC, heating wire and a power supply VDD connected to the IC and the heating wire, the electronic cigarette circuit further comprises a micro-mechanical switches, and the micro-mechanical switch connected with the heating wire and the power supply VDD in series to form a circuit loop. What is the difference from the above embodiments is that the micro-mechanical switch, such as mini touch-switch, mini button-switch and so on, is used as the switch device, the micro-mechanical switch is arranged at a center of the electronic cigarette for convenient control, and the micro-mechanical switch is connected in series with the heating wire and the power supply VDD to form the circuit loop. Therefore, during use, the user only needs to slightly touch the micro-mechanical switch, the loop can be conducted and the heating wire gets heating.

Although embodiments of the present invention are shown and described above, for the persons of ordinary skill in this field, it can be understood that various changes, modifications, substitutes and variants to the embodiments within the spirit of the present invention can be made, and the scope of this invention is determined by the appended claims and their equivalents.

What is claimed is:

1. An electronic cigarette circuit, comprising:

an integrated circuit (IC);

an airflow sensor connected to the IC;

a heating wire; and a power supply connected to the IC and the heat wire;

wherein the electronic cigarette circuit further comprises a light emitting diode (LED) and a switch device placed outside the IC, the switch device are connected with the heating wire and the power supply to form a circuit loop; a first pin of the IC is connected to an end of the airflow sensor; a second pin of the IC is connected to another end of the airflow sensor and an end of the LED and ground, a third pin of the IC is connected to another end of the LED; the switch device is N-type metal-oxide-semiconductor (NMOS) or P-type metal-oxide-semiconductor (PMOS) or a micro-mechanical switch;

when the switch device is an NMOS:

a D pin of the NMOS is connected to an end of the heating wire, another end of the heating wire is connected to the power supply, a fifth pin of the IC and an electrode of a capacitor, another end of the capacitor is grounded, an S pin of the NMOS is grounded, and a G pin of the NMOS is connected to a fourth pin of the IC and an end of a resistance, another end of the resistance is grounded;

or, when the switch device is a PMOS:

a D pin of the PMOS is connected to the power supply, a fifth pin of the IC, an end of a resistance and an electrode of a capacitor, another electrode of the capacitor is grounded, an S pin of the PMOS is connected to one end of the heating wire, the other end of the heating wire is grounded, and a G pin of the PMOS is connected to a fourth pin of the IC and another end of the resistance.

2. The electronic cigarette circuit as described in claim 1, wherein a resistance value of the NMOS or PMOS is 20~60 milliohms.

3. The electronic cigarette circuit as described in claim 2, wherein the resistance value of the NMOS or PMOS is 30 milliohms, 40 milliohms or 50 milliohms.

4. The electronic cigarette circuit as described in claim 1, wherein the micro-mechanical switch connected with the heating wire and the power supply in series to form a circuit loop; the micro-mechanical switch is a mini touch-switch or a mini button-switch; and the micro-mechanical switch is arranged at a center of the electronic cigarette for convenient control.

5. The electronic cigarette circuit as described in claim 1, wherein the power supply is a disposable lithium manganese battery with supply voltage of 3V.

* * * * *